US005624291A

United States Patent [19]

McClaskey

[11] Patent Number: 5,624,291

[45] Date of Patent: Apr. 29, 1997

[54] WAKE BOARD BINDINGS

[76] Inventor: Darryl W. McClaskey, 12552 Hinton Way, Santa Ana, Calif. 92666

[21] Appl. No.: 579,026

[22] Filed: Dec. 14, 1995

[51] Int. Cl.[6] ..... B63B 35/85

[52] U.S. Cl. ..... 441/70

[58] Field of Search ..... 280/607, 617, 280/618; 441/68, 70; 114/39.2

[56] References Cited

U.S. PATENT DOCUMENTS

| | | | |
|---|---|---|---|
| 2,900,648 | 8/1959 | Hedlund et al. | 441/70 |
| 3,089,158 | 5/1963 | Powers | 441/70 |
| 3,917,298 | 11/1975 | Haff | 280/607 |
| 5,021,017 | 6/1991 | Ott | 441/70 |
| 5,232,241 | 8/1993 | Knott et al. | 280/617 |
| 5,277,635 | 1/1994 | Gillis | 441/70 |

*Primary Examiner*—Edwin L. Swinehart
*Attorney, Agent, or Firm*—Charles C. Logan, II

[57] ABSTRACT

A lightweight wake board binding having a thin bottom support plate. A heel receptacle and a top-of-the-foot retainer strap are secured to the top surface of the bottom support plate by a left and a right side plate stiffener member that substantially eliminates the flex in the bottom support plate produced by the person riding the wake board. The plate stiffeners have upstanding flanges adjacent their inner edges having elongated slots therein that receive a fastening strap for tightly securing the binding to the wearer's foot.

12 Claims, 3 Drawing Sheets

WAKE BOARD BINDINGS

BACKGROUND OF THE INVENTION

The invention relates to foot bindings designed to be used on wake boards. Wake boards are a new form of recreational equipment and the person riding them can be towed behind a boat or a jet ski.

The wake board bindings are mounted transversely to the longitudinal axis of the wake board in the same manner bindings are mounted on a snow board. The wake boards have an 8 inch bolt pattern for each of the bindings and this is an industry standard. This makes all the bindings in the industry interchangeable on a wake board and these bindings presently weigh from 2.5 to 3.5 pounds each. The total weight of both wake board bindings add 5 to 7 pounds to the wake board. Riders of wake boards that do slalom and acrobatic maneuvers find the excessive weight, tiring, cumbersome and objectionable.

There has been a need for a lighter weight foot binding. Attempts to use plastic bottom support plates have not been successful because they flex to much as the wake board rider is performing maneuvers.

It is an object of the invention to provide a novel wake board binding that is much lighter in weight than what is presently available in the industry.

It is another object of the invention to provide a novel wake board binding that puts the wearer's foot closer to the top surface to the board and gives them more leverage when making turns on the board.

It is also an object of the invention to provide a novel wake board binding that is economical to manufacture and market.

It is an additional object of the invention to provide a novel wake board binding that provides better support to the user's foot on the wake board.

SUMMARY OF THE INVENTION

The novel wake board binding has a U-shaped bottom support plate preferably made of aluminum and have a thickness in the range of 0.060–0.100 inches. The reduced thickness of the bottom support plate and the weight saved by cutting out the central portion of the support plate provides a great savings in the amount the wake board binding weighs. The thinness of the bottom support plate results in it having unwanted flexing when the user is performing turns and acrobatic maneuvers. This is primarily due to the fact that the wake board binding is only attached to the wake board by two bolts that are spaced 8 inches apart from each other. This is an industry standard. The bindings are aligned transversely to the longitudinal axis of the wake board. The two bolt fastening system results in a flexing motion of the bottom support both fore and aft. By using the novel elongated plate stiffener members, the unwanted flexing is minimized or eliminated.

The novel plate stiffener members also have an upstanding flange adjacent their inner edge with an elongated slot therein. These slots allow a foot retainer strap to be threaded therethrough. The foot retainer strap provides a positive support for the rider's foot on the wake board. The novel structure of the heel receptacle and top-of-the-foot retainer strap also produce a better snug fit on the rider's foot.

The foot cushion pad is preferably made of rubber or a similar material. It covers the cutout area of the U-shaped bottom support plate. The double offset hole pattern provided adjacent the left and right edges of the bottom support plate provide extra angular positions to which the wake board bindings can be oriented.

DESCRIPTION OF THE PREFERRED EMBODIMENT

Figure 1:
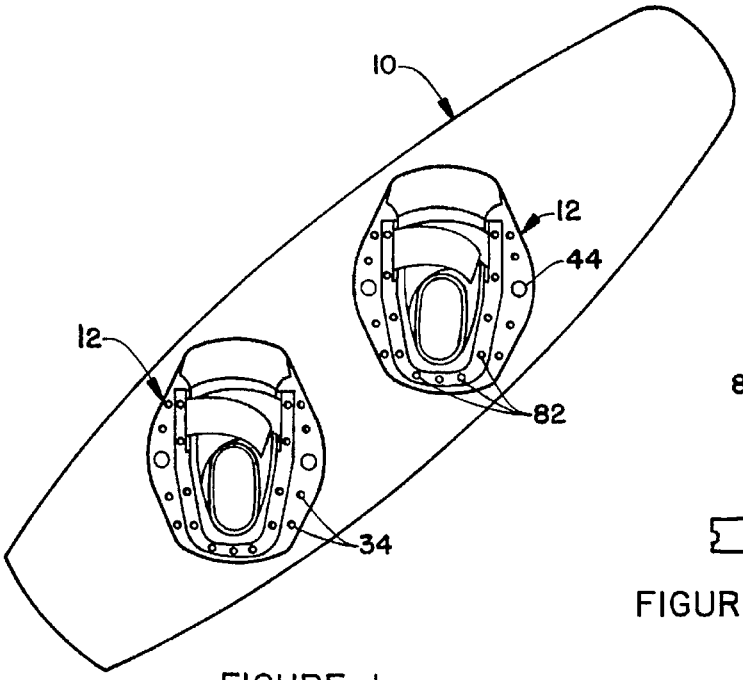
FIG. 1 is a top plan view of a pair of the novel wake board bindings mounted on a wake board.
Figure 6:
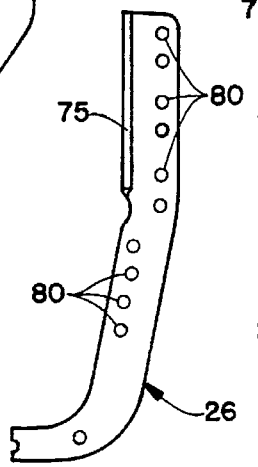
FIG. 6 is a top plan view of the high wrap model plate stiffener member.
Figure 7:
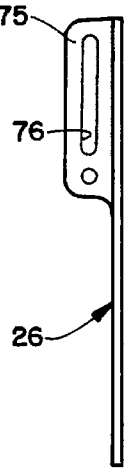
FIG. 7 is a side elevation view of the plate stiffener member illustrated in FIG. 6.
Figure 3:
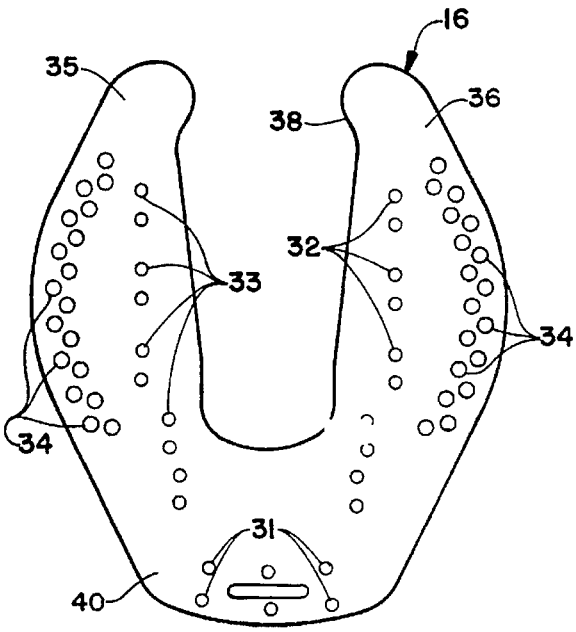
FIG. 3 is a top plan view of the U-shaped bottom support plate.
Figure 4:
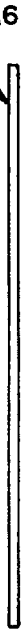
FIG. 4 is a side elevation view of the U-shaped bottom support plate.
Figure 5:
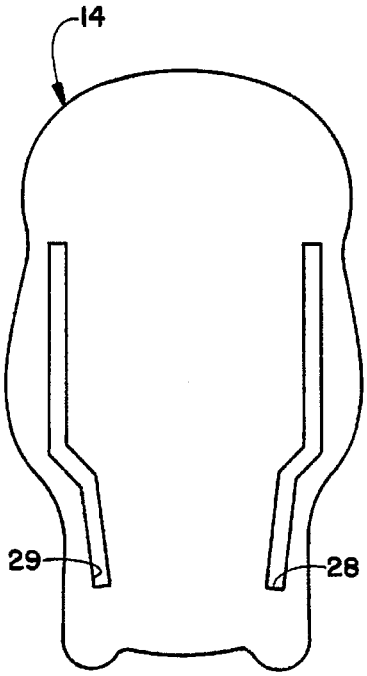
FIG. 5 is a top plan view of the foam pad.

The novel wake board binding will now be described by referring to FIGS. 1–8 of the drawings. The wake board is generally designated numeral 10 and the wake board bindings are generally designated numeral 12.

Wake board binding 12 has a polyurethane shock absorption pad 13, a foam pad 14, a U-shaped bottom support plate 16, a foot cushion pad 18, a heel receptacle 20, a top-of-the-foot retainer strap 22 and a transverse adjustable heel strap 24. Plate stiffener members 26 secure the respective members together in the manner to be described.

Foam pad 14 has a pair of laterally spaced slots 28 and 29 that provide access for bolts 30 that are inserted through apertures 31, 32 and 33 in bottom support plate 16. Foam pad 14 has a thickness T3 that is in the range of 0.05–0.10 inches. Binding apertures 31 are formed in bottom support plate 16 in its rear transverse portion 34. Binding apertures 33 are formed in left leg portion 35 and binding apertures 32 are formed in right leg portion 36. Bottom support plate 16 has a central cutout portion 38. Apertures 34 along the outside edges of leg portions 35 and 36 are mounting apertures through which bolts 42 pass and which are tightened in position by nuts 44. The double offset hole pattern allows extra angular positions for the wake board bindings.

Bottom support plate 16 has a thickness T1 in the range of 0.060–0.100 inches.

Top-of-the-foot retainer strap 22 has outwardly extending flanges 46 and 47 having apertures 50 therein. Apertures 50 align with binding apertures 32 and 33 for receiving screws 30. Heel receptacle 20 has a rear wall 52, a right side wall 54 and a left side wall 55. A flange 57 extends outwardly from its bottom edge and it has apertures 59 that align with binding apertures 31, 32 and 33 on bottom support plate 16. A right strip member 60 and a left strip member 61 extends forwardly from the respective side walls 54 and 55. A strip of hook and loop material 63 is mounted on the outer surface of right strip member 60. One end of the fastening strap 65 is sewn on left strip member 61 and it has a strip of hook and loop material 67 adjacent its free end. A loop strap 68 is secured to rear wall 62 adjacent its top edge.

Transverse adjustable heel strap 24 has a web portion 70 having a grommet 71 having an aperture 72 is secured to one end. The other end of web portion 70 is threaded through a slot 73 in bracket 74 that has an aperture 75. Strips 76 and 77 of hook and loop material are stitched on to web 70 and allows strap 24 to be tightened down for different size feet. Two bolts 30 have their shanks threaded through apertures 78 in upstanding flanges 75 and then through their apertures 72 and 75. Nuts 82 are threaded on bolts 30 to secure heel strap 24 to plate stiffener members 26.

Plate stiffener members 26 extend substantially from the rear end of heel receptacle 20 to the front end of top-of-the-foot retainer strap and they have upstanding flanges 79 adjacent their inner edges near their front ends. Slots 84 are formed in upstanding flanges 79 and function to receive fastening strap 65 that is first threaded through the right plate stiffener and then up and over the top of the wearer's foot and through slot 84 of the right plate stiffener 26. Plate stiffeners 26 are positioned on the top of the respective flanges 46 and 47 of top-of-the-foot retainer strap 22 and on the top of flange 57 of heel receptacle 20. Apertures 80 then align with apertures 50 and apertures 59 to receive bolts 30 that have nuts 82 tighten thereon. Plate stiffeners 26 have a thickness T4 in the range of 0.060–0.200 inches and a width W1 in the range of 0.375–1.5 inches.

Figures 2, 8:
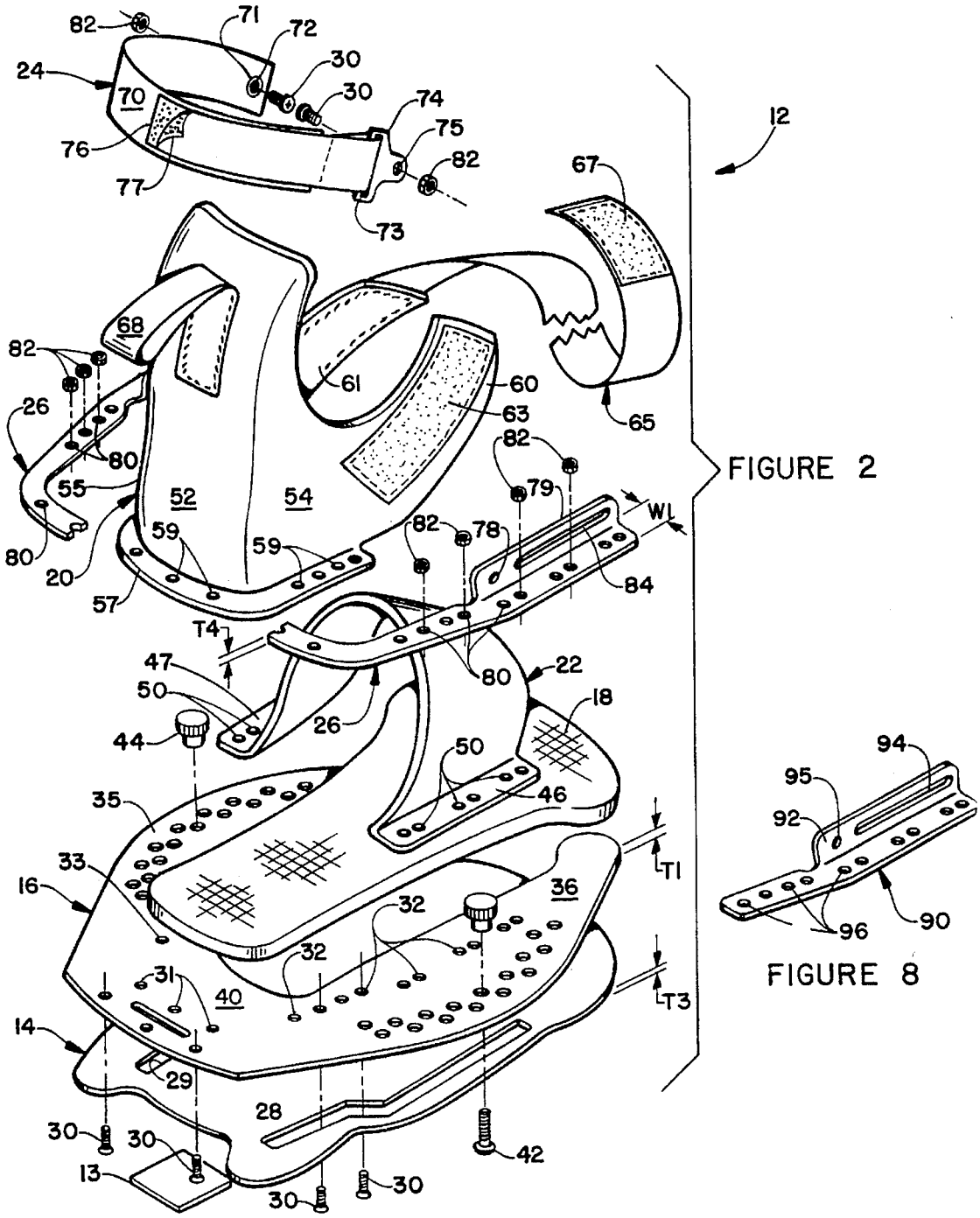
FIG. 2 is an exploded front perspective view of the novel wake board binding.
FIG. 8 is a front perspective view of a low wrap model plate stiffener member.

FIG. 8 illustrates the plate stiffener members 90 that are used with low wrap model wake board bindings. It has an upstanding flange 92 having an elongated slot 94 and an aperture 95 therein. A plurality of apertures 96 are formed along the length of plate stiffener 90.

Figure 9:
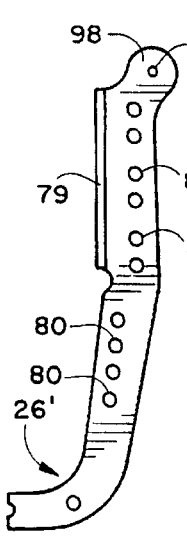
FIGS. 9 and 10 illustrate the first alternative embodiment of the plate stiffener members.
Figure 10:
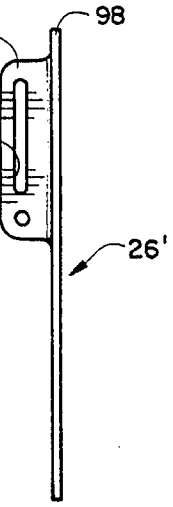
Figure 11:
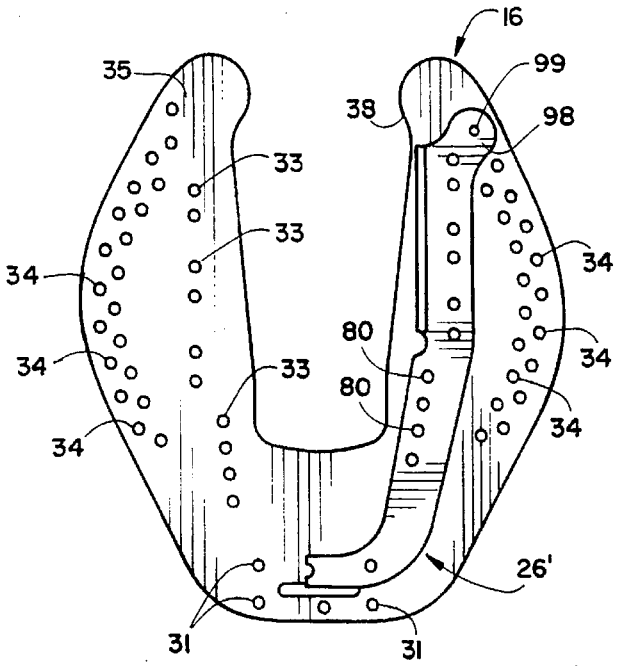
FIG. 11 illustrates the plate stiffener member of FIGS. 9 and 10 and the manner in which they are mounted on the bottom support plate.
Figure 12:
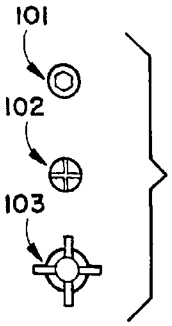
FIG. 12 illustrates a top plan view of a plurality of spacer members.
Figure 13:
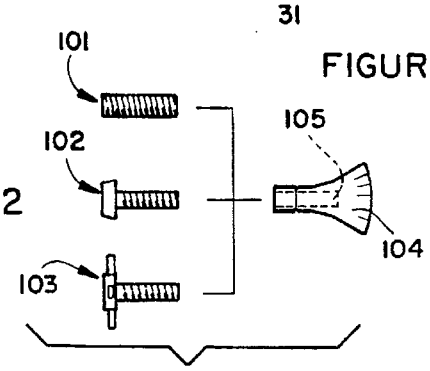
FIG. 13 illustrates in a side elevation view of the plurality of spacer members illustrated in FIG. 12.
Figure 14:
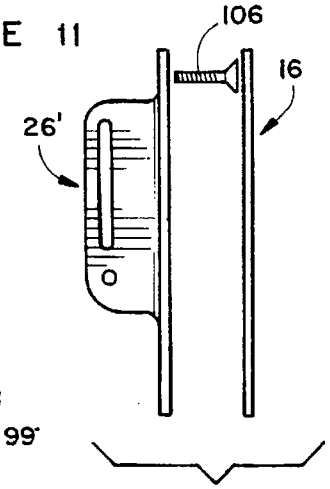
FIG. 14 is a partial side elevation view illustrating one embodiment showing how the spacer members would be utilized.

Alternative embodiment plate stiffener members 26' are illustrated in FIGS. 9 and 10. They include the additional structure of a toe portion 98 extending both forwardly and laterally from the front end of the plate stiffener member. They have an aperture 99. FIG. 11 illustrates the manner in which the right plate stiffener member is positioned upon the top surface of bottom support plate 16. FIGS. 12 and 13 illustrate various spacer members. These are an Allen head bolt 101, a Phillips head 102 bolt and a knob-head bolt 103. FIG. 12 illustrates a top plan of each of the respective spacer structures. Each of the different types of bolts would be used in combination with a tension cup 104 having an internally threaded bore 105. FIG. 14 shows an exploded partial view illustrating a spacer bolt 106 positioned between the top surface of bottom support plate 16 and the bottom surface of plate stiffener member 26 prime. A nut 108 and washers 109 could be threaded on to bolt 106.

Figure 15:
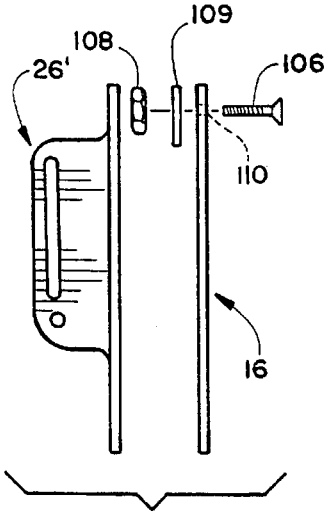
FIG. 15 is a partial side elevation view illustrating a second manner in which the spacer members are used.
Figure 16:
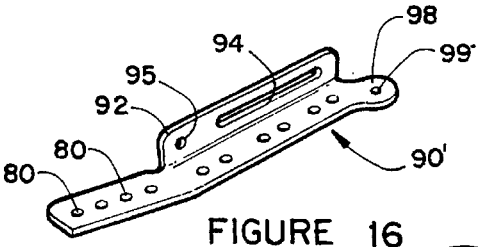
FIG. 16 is a front perspective view of an alternative version of the low wrap model plate stiffener member.

In the embodiment illustrated in FIG. 15, an aperture 110 is formed in bottom plate support member 16 and bolt 106 is threaded therethrough.

Figure 17:
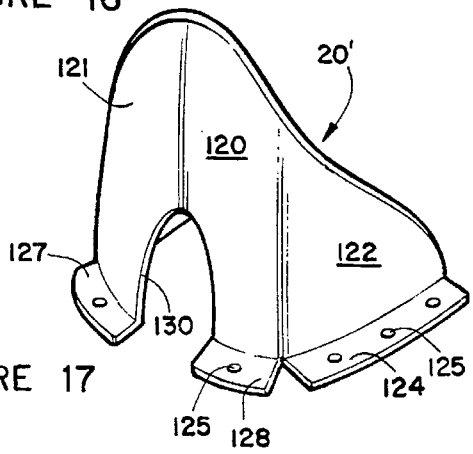
FIG. 17 is a rear perspective view of an alternative embodiment heel receptacle.

An alternative embodiment heel receptacle 20' is illustrated in FIG. 17. It has a rear wall 120, a left side wall 121 and a right side wall 122. Side flanges 124 extend from the respective side walls 121 and 122 and they have apertures 125 therein. A pair of laterally spaced rear flanges 127 and 128 extend rearwardly from rear wall 120. An achilles cutout portion 130 is formed in rear wall 120.

What is claimed is:

1. A wake board binding comprising:

a bottom support plate having a front end, a rear end, a left edge, a right edge, a top surface, a bottom surface, a predetermined thickness T1; a first row of apertures extending from front to rear along said left edge, a second row of apertures extending from front to rear along said right edge;

a heel receptacle having a front end, a rear end, a top edge, a bottom edge, a rear wall, a left side wall, a right side wall, and an outwardly extending flange adjacent its bottom edge; said flange having a plurality of apertures for securing said heel receptacle to the top surface of said bottom support plate;

a transversely extending elongated top-of-the-foot retainer strap having a left end, a right end, and an outwardly extending flange adjacent said left end and said right end; said flanges each having a plurality of apertures for securing said top-of-the-foot retaining strap to the top surface of said bottom support plate; and plate stiffener means for clamping the respective left and right end flanges of said top-of-the-foot retainer strap to the top surface of said bottom support plate; said plate stiffener means also clamping the left and right flanges of said heel receptacle to the top surface of said bottom support plate; said plate stiffener means comprising an elongated left side plate stiffener member and an elongated right side plate stiffener member; said plate stiffener members each having a front end, a rear end, an inner edge, an outer edge, and a width W1; a plurality of apertures are formed along the length of said plate stiffener members and they align with said apertures in the respective flanges of said heel receptacle and said top-of-the-foot retainer strap; said plate stiffener members each have an upstanding flange along their inner edges adjacent their front end; said upstanding flanges each have an elongated slot for receiving a fastening strap.

2. A wake board binding comprising:

a bottom support plate having a front end, a rear end, a left edge, a right edge, a top surface, a bottom surface, a predetermined thickness T1; a first row of apertures extending from front to rear along said left edge, a second row of apertures extending from front to rear along said right edge; said bottom support plate has a U-shaped configuration having a pair of laterally spaced leg portions connected together by a rear transverse portion;

a heel receptacle having a front end, a rear end, a top edge, a bottom edge, a rear wall, a left side wall, a right side wall, and an outwardly extending flange adjacent its bottom edge; said flange having a plurality of apertures for securing said heel receptacle to the top surface of said bottom support plate;

a transversely extending elongated top-of-the-foot retainer strap having a left end, a right end, and an outwardly extending flange adjacent said left end and said right end; said flanges each having a plurality of apertures for securing said top-of-the-foot retaining strap to the top surface of said bottom support plate; and plate stiffener means for clamping the respective left and right end flanges of said top-of-the-foot retainer strap to the top surface of said bottom support plate; said plate stiffener means also clamping the left and right flanges of said heel receptacle to the top surface of said bottom support plate.

3. A wake board binding as recited in claim 2 wherein W1 is 1 inch or less.

4. A wake board binding comprising:

a bottom support plate having a front end, a rear end, a left edge, a right edge, a top surface, a bottom surface, a predetermined thickness T1; a first row of apertures extending from front to rear along said left edge, a second row of apertures extending from front to rear along said right edge;

a heel receptacle having a front end, a rear end, a top edge, a bottom edge, a rear wall, a left side wall, a right side wall, and an outwardly extending flange adjacent its bottom edge; said flange having a plurality of apertures for securing said heel receptacle to the top surface of said bottom support plate;

a transversely extending elongated top-of-the-foot retainer strap having a left end, a right end, a front end, and an outwardly extending flange adjacent said left end and said right end; said flanges each having a plurality of apertures for securing said top-of-the-foot retaining strap to the top surface of said bottom support plate; and plate stiffener means for clamping the respective left and right end flanges of said top-of-the-foot retainer strap to the top surface of said bottom support plate; said plate stiffener means also clamping the left and right flanges of said heel receptacle to the top surface of said bottom support plate; said plate stiffener means comprising an elongated unitary left side plate stiffener member and an elongated unitary right side plate stiffener member; said two plate stiffener members each having a front end, a rear end, an inner edge, an outer edge, and they extend continuously from the front end of said top-of-the-foot retainer strap to the rear end of said heel receptacle; a plurality of apertures are formed along the length of said plate stiffener members and they align with said apertures in the respective flanges of said heel receptacle and said top-of-the-the foot retainer strap.

5. A wake board binding as recited in claim 4 wherein T1 is in the range of 0.060–0.100 inches.

6. A wake board binding as recited in claim 5 wherein said bottom support plate is made of aluminum.

7. A wake board binding as recited in claim 4 further comprising an elongated foot cushion pad mounted on the top surface of said bottom support plate upon which the bottom of a person's foot rests.

8. A pair of wake board bindings as recited in claim 4 detachably mounted on a wake board.

9. A wake board binding as recited in claim 4 further comprising a loop strap attached to the rear of said heel receptacle for helping a person insert their foot into said binding.

10. A wake board binding as recited in claim 4 further comprising an elongated transverse adjustable heel strap having a left end and a right end; and means for securing said left end and right end to said plate stiffener means.

11. A wake board binding as recited in claim 4 further comprising an elongated foam pad secured to the bottom surface of said bottom support plate for absorbing vibration.

12. A wake board binding comprising:

a bottom support plate having a front end, a rear end, a left edge, a right edge, a top surface, a bottom surface, a predetermined thickness T1; said bottom support plate having a U-shaped configuration formed with a central cutout portion between left and right leg portions and a rear transverse portion; an outer row of apertures extending from front to rear along said left edge and said right edge, an inner row of apertures extending from front to rear along said left and right edges; the apertures of said respective outer rows of apertures being longitudinally offset from their respective inner rows to form a double offset hole pattern that allows the binding to be moved forwardly and rearwardly depending upon the length of a rider's foot; the apertures of the respective outer and inner rows allow the binding to also be angularly rotated to various fixed angular positions with respect to the sides of a wake board;

a heel receptacle having a front end, a rear end, a top edge, a bottom edge, a rear wall, a left side wall, a right side wall, and an outwardly extending flange adjacent its bottom edge; said flange having a plurality of apertures for securing said heel receptacle to the top surface of said bottom support plate;

a transversely extending elongated top-of-the-foot retainer strap having a left end, a right end, and an outwardly extending flange adjacent said left end and said right end; said flanges each having a plurality of apertures for securing said top-of-the-foot retaining strap to the top surface of said bottom support plate; and plate stiffener means for clamping the respective left and right end flanges of said top-of-the-foot retainer strap to the top surface of said bottom support plate; said plate stiffener means also clamping the left and right flanges of said heel receptacle to the top surface of said bottom support plate.

* * * * *